US012137821B2

(12) United States Patent
Huff et al.

(10) Patent No.: US 12,137,821 B2
(45) Date of Patent: Nov. 12, 2024

(54) REFRIGERATED DISPLAY CABINET

(71) Applicant: Carrier Corporation, Palm Beach Gardens, FL (US)

(72) Inventors: Hans-Joachim Huff, Mainz-Kostheim (DE); Benjamin Kahl, Mainz-Kostheim (DE); Silke Henn, Mainz-Kostheim (DE)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/939,488

(22) Filed: Sep. 7, 2022

(65) Prior Publication Data

US 2023/0077226 A1 Mar. 9, 2023

(30) Foreign Application Priority Data

Sep. 8, 2021 (EP) ..... 21195612

(51) Int. Cl.
*A47F 3/04* (2006.01)
*F24F 11/36* (2018.01)

(52) U.S. Cl.
CPC ..... *A47F 3/0443* (2013.01); *F24F 11/36* (2018.01)

(58) Field of Classification Search
CPC ..... F25D 23/003; F25D 23/006; F24F 11/36; A47F 3/0443; F25C 1/22; B65D 81/3816
See application file for complete search history.

(56) References Cited

U.S. PATENT DOCUMENTS

| | | | | |
|---|---|---|---|---|
| 2,288,166 | A | 6/1942 | Kucher | |
| 5,347,827 | A * | 9/1994 | Rudick | A47F 3/0408 62/255 |
| 6,073,455 | A | 6/2000 | Tachigori et al. | |
| 6,085,531 | A | 6/2000 | Numoto et al. | |
| 10,060,645 | B2 | 8/2018 | Yamaguchi et al. | |
| 10,247,441 | B2 | 4/2019 | Suzuki et al. | |
| 10,731,884 | B2 | 8/2020 | Blanton | |
| 10,935,454 | B2 | 3/2021 | Kester | |
| 11,041,666 | B2 | 6/2021 | Sakae et al. | |

(Continued)

FOREIGN PATENT DOCUMENTS

| | | |
|---|---|---|
| CN | 103884480 B | 7/2016 |
| CN | 106766661 A | 5/2017 |

(Continued)

OTHER PUBLICATIONS

European Search Report for Application No. 21195612.3; Issued Feb. 28, 2022; 8 Pages.

*Primary Examiner* — Nelson J Nieves
(74) *Attorney, Agent, or Firm* — CANTOR COLBURN LLP

(57) ABSTRACT

A refrigerated display cabinet (10) includes a refrigeration loop including a compressor, a condenser, a throttling element and an evaporator which are connected; a main body (12) including a storage space (14), wherein the evaporator (16) is located within the main body and is for supplying cooling to the storage space (14); and a container (18) located outside of the storage space (12) and containing at least one of the compressor, condenser and throttling element, wherein the container (18) comprises a vent (20) configured to discharge any build-up of gases within the container (18) outwardly.

18 Claims, 3 Drawing Sheets

(56) References Cited

U.S. PATENT DOCUMENTS

| | | | | |
|---|---|---|---|---|
| 2003/0131438 | A1* | 7/2003 | Holman | B01D 41/04 15/316.1 |
| 2008/0184715 | A1* | 8/2008 | Chen | F25B 47/022 62/81 |
| 2010/0018230 | A1* | 1/2010 | Ihle | F25D 23/003 62/407 |
| 2013/0014524 | A1* | 1/2013 | Kim | F25B 49/00 62/125 |
| 2013/0152623 | A1* | 6/2013 | Resch | A47F 3/0443 62/465 |
| 2014/0014436 | A1* | 1/2014 | Nguyen | F24F 13/24 181/210 |
| 2014/0216096 | A1* | 8/2014 | Leclear | F25B 1/005 29/890.035 |
| 2017/0234592 | A1* | 8/2017 | Kawashima | F25B 13/00 62/408 |
| 2017/0370605 | A1* | 12/2017 | Makino | F24F 11/36 |
| 2018/0120017 | A1* | 5/2018 | Wilson | F25D 23/006 |
| 2018/0120194 | A1* | 5/2018 | Roth | H05K 7/20354 |
| 2019/0186798 | A1* | 6/2019 | Goel | F25B 49/005 |
| 2019/0390873 | A1* | 12/2019 | Suzuki | F25B 49/02 |
| 2020/0072528 | A1* | 3/2020 | Buzzi | B01D 46/10 |
| 2020/0284494 | A1* | 9/2020 | Garcia | F25B 39/04 |
| 2021/0025641 | A1* | 1/2021 | Thomas | F25D 19/04 |
| 2021/0123624 | A1* | 4/2021 | Kronstrom | F24F 11/49 |
| 2021/0207831 | A1 | 7/2021 | Lord et al. | |
| 2021/0278128 | A1* | 9/2021 | Scarcella | F25B 49/005 |
| 2022/0057132 | A1* | 2/2022 | Ivanov | F25D 23/003 |
| 2022/0090830 | A1* | 3/2022 | Sung | F28F 9/0212 |

FOREIGN PATENT DOCUMENTS

| | | | | | |
|---|---|---|---|---|---|
| CN | 206488543 | U | | 9/2017 | |
| CN | 210300387 | U | | 4/2020 | |
| DE | 1501036 | A1 | | 10/1969 | |
| DE | 202016103305 | U1 | | 7/2016 | |
| DE | 102019124531 | A1 | | 3/2021 | |
| EP | 0768198 | B1 | | 11/2003 | |
| EP | 2589900 | B1 | | 5/2013 | |
| EP | 1321723 | B1 | | 11/2013 | |
| EP | 3222941 | A1 | | 9/2017 | |
| EP | 3396277 | B1 | | 10/2018 | |
| EP | 3260791 | B1 | | 4/2019 | |
| EP | 3228957 | B1 | | 7/2019 | |
| EP | 3264000 | B1 | | 8/2019 | |
| EP | 3279582 | B1 | | 10/2019 | |
| EP | 3557162 | A1 | | 10/2019 | |
| EP | 3279591 | B1 | | 1/2020 | |
| EP | 3346203 | B1 | | 1/2020 | |
| EP | 2647920 | B1 | | 3/2020 | |
| EP | 3633277 | A1 | | 4/2020 | |
| EP | 3650785 | A1 | | 5/2020 | |
| EP | 3318823 | B1 | | 10/2020 | |
| EP | 3569955 | B1 | | 5/2021 | |
| EP | 3832219 | A1 | | 6/2021 | |
| EP | 3839360 | A1 | | 6/2021 | |
| EP | 3214391 | B1 | | 7/2021 | |
| JP | 04208380 | A | * | 7/1992 | |
| JP | H07127963 | A | | 5/1995 | |
| JP | 10334327 | A | * | 12/1998 | |
| JP | H11173713 | A | | 7/1999 | |
| JP | 11344280 | A | * | 12/1999 | |
| JP | 2001336841 | A | | 12/2001 | |
| JP | 2002092714 | A | | 3/2002 | |
| JP | 2002115952 | A | | 4/2002 | |
| JP | 3462785 | B2 | | 11/2003 | |
| JP | 2004317024 | A | * | 11/2004 | F25D 21/14 |
| JP | 2005055164 | A | * | 3/2005 | |
| JP | 2005201529 | A | * | 7/2005 | |
| JP | 2005241121 | A | | 9/2005 | |
| JP | 2005274088 | A | * | 10/2005 | |
| JP | 2008032389 | A | | 2/2008 | |
| JP | 2012127519 | A | | 7/2012 | |
| JP | 2018115782 | A | | 7/2018 | |
| WO | 2020014279 | A1 | | 1/2020 | |
| WO | 21050699 | A1 | | 3/2021 | |

* cited by examiner

REFRIGERATED DISPLAY CABINET

FOREIGN PRIORITY

This application claims priority to European Patent Application No. 21195612.3, filed Sep. 8, 2021, and all the benefits accruing therefrom under 35 U.S.C. § 119, the contents of which in its entirety are herein incorporated by reference.

TECHNICAL FIELD OF INVENTION

The present invention relates to refrigerated display cabinets, and more specifically, refrigerated display cabinets with refrigerant leak mitigation. Corresponding methods are also described.

BACKGROUND OF THE INVENTION

Refrigerated display cabinets as used in retail environments provide refrigerated display spaces for refrigerated goods, such as perishable goods or goods where a chilled sales condition is preferred by the consumer. The refrigerated display cabinet keeps the goods below ambient temperature by the use of cooled air that is circulated around the goods. Typically a refrigerated display cabinet will include a storage space with a number of horizontal shelves and an opening at a front side of the shelves. The opening permits a consumer and/or retail staff to access the shelves and the goods thereon from the front of the storage space. In some cases the opening can be shielded by a door or a curtain. An air curtain may be used, for example a flow of cooled and/or ambient air across the opening. Cooling for the refrigerated display cabinet is provided by heat exchange with a heat absorbing heat exchanger of a cooler. This may be a cooler integrated with the display cabinet, such as a refrigeration loop with an evaporator of the refrigeration loop being the heat absorbing heat exchanger. The refrigerant loop further comprises a condenser as a heat rejection heat exchanger, which is usually located away from the refrigerated space, such as behind, above or below the refrigerated display cabinet. In some cases a cooling system at a remote location may link to heat rejection heat exchangers at multiple refrigerated display cabinets via a heat exchange circuit.

The refrigerant used in the refrigeration loop is usually flammable, for example hydrocarbons such as propane are typically used as refrigerant, and hence there is a risk of an explosive atmosphere in the vicinity of the refrigerated cabinet if refrigerant were to leak and be allowed to accumulate.

A need therefore exists for a refrigerated cabinet design that prevents the accumulation of refrigerant in the event of a refrigerant leak.

SUMMARY OF THE INVENTION

Viewed from a first aspect, the present invention provides a refrigerated display cabinet, comprising: a refrigeration loop comprising a compressor, a condenser, a throttling element and an evaporator which are connected; a main body comprising a storage space, wherein the evaporator is located within the main body and is for supplying cooling to the storage space; and a container located outside of the storage space and containing at least one of the compressor, condenser and throttling element, wherein the container comprises a vent configured to discharge any build-up of gases within the container outwardly.

With this arrangement, any gas leak, such as a refrigerant leak, from any component contained within the container, will build up within the container. As the gas builds up within the container the gas is discharged through the vent due to a pressure differential between the inner of the container and the ambient atmosphere outside of the container. As discussed below, the pressure within the container may increase due to build-up of gas, and this may drive the discharge of gas. Alternatively or additionally the container may include venting fans for generating/increasing the pressure differential. Advantageously the gas is discharged from the vent in a jetting fashion, e.g. forming a plume of discharge gas/air extending away from the container. As it is discharged any leaked gas will mix with the surrounding air and will be diluted. The use of a jetting effect from the vent ensures that the leaked gas is spread into a greater area of the outside air and hence is diluted more thoroughly. This therefore prevents any build-up of potentially harmful gases, such as a refrigerant leak, in the vicinity of the refrigerated display cabinet. That is, any build-up of potentially harmful gases are contained within the container and are diluted with ambient air when emitted from the container.

It will be appreciated that the refrigerated display cabinet is oriented in use with a top and a base, and hence as used herein references to horizontal and vertical should be understood with reference to that orientation. The refrigerated display cabinet has a vertical extent between the top and the base thereof, and a horizontal extent between the front and back (a depth of the cabinet), as well as between two sides (a width of the cabinet). The storage space may be accessible from a front of the refrigerated display cabinet. The refrigeration display cabinet may have a height greater than 1.5 m. The refrigeration display cabinet may have a height greater than 2 m. The refrigeration display cabinet may have a height of about 2.5 m or less.

It will also be appreciated that the container may be cuboid in its geometry. However it may also be an irregular shape for example multiple cuboids interconnected or other shapes suitable for containing refrigeration loop components. The container shape may be irregular to accommodate the positioning of refrigeration loop components.

In the example where the container comprises the compressor the vent may be located at a position of the container away from the compressor and/or without any unobstructed internal line of sight between the compressor and the vent. This can aid in preventing noise from the compressor being transmitted to the vent and/or out of the vent and hence reduces the noise being transmitted in the vicinity of the refrigerated display cabinet.

The container may be configured to be air tight with the exception of the vent. This allows for an increase in pressure from a leak to generate the jetting effect of the type discussed above. Alternatively, in examples using a venting fan as discussed below, the container may be airtight aside from the vent for discharge of gas and air inlets to allow the venting fan(s) to draw air into the container.

The container may further contain at least one of a filter-drier, pressure switches and refrigerant tubing.

In examples where the container comprises further components of the refrigeration loop the likelihood that a leak of the refrigeration loop is contained within the container is increased and hence the likelihood of refrigerant building up in the vicinity of the refrigerated display cabinet is reduced.

An evaporator fan may be provided within the storage space, proximate to the evaporator, the evaporator and the evaporator fan being configured to cool the storage space. That is, the evaporator and the evaporator fan may be configured to exchange heat between the relatively cold refrigerant at the condenser and the relatively hot atmosphere within the storage space.

The container may be located above the main body. The container may be installed on top of the main body.

The container may be located below the storage space.

The walls of the container may be referred to as inner and outer walls, in this context, an inner wall is a wall that is within or abuts the main body whereas an outer wall is a wall external to the main body.

In examples where the container is located above the main body the inner wall of the container is the bottom wall that abuts the main body and the remaining walls are outer walls. That is the outer walls are walls that have an outer face exposed to the atmosphere surrounding the refrigerated display cabinet.

In examples where the container is located below the storage space the inner walls of the container are those that are within the main body and the outer wall is a wall that is exterior to the main body or partially defines the main body outer bound. That is, an outer wall in examples where the container is located below the storage space has one face exposed to the atmosphere surrounding the refrigerated display cabinet.

The condenser may be a liquid cooled condenser. The refrigerated display cabinet may be a semi-plug in refrigerated display cabinet. That is cooling fluid, such as water or a brine solution, may be provided to the condenser from a cooling fluid supply. The condenser may be a shell and tube heat exchanger, or the like, configured to exchange heat between the cooling liquid and the relatively hot refrigerant of the refrigeration loop.

In examples where the condenser is a liquid cooled condenser the condenser may not have a corresponding condenser fan as is typically used in air cooled condensers. The absence of a condenser fan reduces both noise and spatial requirements at the condenser.

The vent for discharge of gas may be located on an inner wall of the container and may be configured to enable fluid communication between the interior of the container and the interior of the storage space such that any build-up of gases within the container is discharged into the storage space.

In examples where the vent is located on an inner wall of the container, that is where the vent fluidly connects the container and the storage space, any build-up of gases, such as leaked refrigerant, is discharged through the vent due to the pressure differential between the inner of the container and the storage space. As it is discharged any leaked gas will mix with the surrounding air within the storage space and will be diluted. In the example where the evaporator has a corresponding fan within the storage space the mixing of leaked gas with the surrounding air will be enhanced by the fluid flows and turbulences generated by the fan or blower.

The vent may be located on an outer wall of the container and may be configured to discharge any build-up of gases from within the container in a direction outwards.

The vent may be configured to discharge any build-up of gases from within the container in a direction vertically upwards. That is, the vent may be configured to discharge any build-up of gases from within the container in a direction opposed to gravity.

The vent may be configured to discharge any build-up of gases from within the container in a horizontal direction.

In examples where the vent is located on an outer wall of the container any build-up of gases, such as leaked refrigerant, is discharged through the vent due to the pressure differential between the inner of the container and the ambient atmosphere. As it is discharged, any leaked gas will mix with the surrounding air and will be diluted. In the event that the build-up of gas is refrigerant gas, e.g. from a refrigerant leak, the gas stream being discharged will gradually decelerate as it moves outwards from the vent due to gravity and refrigerant being heavier than air. At a distance away from the vent, the gas stream will change direction from being opposed to gravity to the direction of gravity due to the refrigerant being heavier than air. This may be understood as a fountain effect and can be understood as a refrigerant fountain emanating from the vent. This effect causes significant mixing with the ambient air surrounding the refrigerated display cabinet and hence dilutes the leaked refrigerant. Accordingly, a build-up of leaked refrigerant in the vicinity of the refrigerated display cabinet is prevented.

The refrigerated display cabinet may further comprise a second vent, the second vent being located on an inner wall of the container which may be configured to enable fluid communication between the container and the storage space such that higher pressure within the storage space causes an increase in the flow rate of any build-up of gases exiting the first vent from within the container.

The evaporator may be provided with a fan. The evaporator fan may cause higher pressure within the storage space relative to the container.

In examples where the refrigerated display cabinet comprises a second vent there is an increase in flow rate through the first vent increasing the rate of leaked refrigerant dispersal and further it allows for leaked refrigerant to be purged from the container after the leak has ended so that the container can be opened for service without releasing residual leaked refrigerant. For example, the container may be opened without releasing explosive gas.

In examples where the refrigerated display cabinet comprises vents on both an outer and an inner wall of the container the benefits and effects described above individually with respect to each vent location are achieved in unison. This can both increase the rate of discharge of built-up gas within the container as well as further reducing the ability of gas to build up in the vicinity of the refrigerated display cabinet.

The vent may be configured to discharge any build-up of gases within the container in a high velocity stream. The vent may have a cross-sectional area that is sized to cause any build-up of gases to be discharged in a high velocity stream. That is, the vent may have a cross-sectional area, that at a predetermined gas build up pressure, acts as a flow restriction causing a high velocity stream or jet of built up gas to be discharged.

The vent may be configured to discharge any build-up of gases within the container in a turbulent stream. The vent may have a cross-sectional shape that is configured to induce a turbulent stream or jet of built up gas to be discharged.

The vent may be configured to discharge any build-up of gases within the container in both a high velocity and highly turbulent stream. This may be achieved by the vent having a cross-sectional area and shape as described above.

In the case of any build-up of gases being discharged in a high velocity stream and/or highly turbulent stream the mixing with air surrounding the stream is increased. This increases the dilution of the leaked gas and thus prevents build-up of gas in the vicinity of the refrigerated display cabinet.

The refrigerated display cabinet may further comprise a venting fan for discharging any build-up of gases within the container outwardly from the container.

In the example of the display cabinet further comprising a venting fan the gas dispersal is increased due to the increased air flow provided by the venting fan and by turbulence generated through action of the venting fan.

The venting fan may be located at the vent.

The vent may have a cross sectional area proportional to the size of the venting fan to maximise the airflow generated, e.g. the vent area may be determined based on the size of the venting fan and/or on the air flow capacity of the venting fan. The vent may comprise a plurality of vents in close proximity to the venting fan.

The refrigerated display cabinet may further comprise a second venting fan for discharging any build-up of gases within the container outwardly from the container; and an air inlet.

The refrigerated display cabinet may comprise two air inlets.

In the example of the display cabinet comprising two venting fans and/or two air inlets redundancy is achieved. That is, if a fan were to fail and/or an air inlet were to be blocked refrigerant leak mitigation can still be achieved.

The venting fan or venting fans may be configured to discharge gases vertically from the container. The venting fan or venting fans may be configured to discharge gases horizontally from the container.

The direction the venting fan or venting fans discharge gas may be due to the direction they point. The venting fan or venting fans may be further provided with a flow director to direct the gas being discharged.

The refrigerated display cabinet may comprise a second venting fan located at an air inlet for drawing air into the container from outside.

In the example of the display cabinet comprising a second fan drawing air into the container additional turbulence can be generated within the container to increase refrigerant dispersal.

Viewed from a second aspect, the present invention provides a method of refrigerant leak mitigation for a refrigerated display cabinet, the method comprising: capturing leaking refrigerant from refrigerant loop components of a refrigerated display cabinet within a container; and venting the build-up of refrigerant from the container outwardly.

Viewed from another aspect, the present invention provides a method for manufacturing a refrigerated display cabinet with refrigerant leak mitigation, the method comprising: providing a refrigerated display cabinet including: a refrigeration loop comprising a compressor, a condenser, a throttling element and an evaporator which are connected; a main body comprising a storage space, wherein the evaporator is located within the main body and is for supplying cooling to the storage space; a container located outside of the storage space and containing at least one of the compressor, condenser and throttling element; and forming a vent in the container configured to discharge any build-up of gases within the container outwardly.

BRIEF DESCRIPTION OF THE DRAWINGS

Certain preferred embodiments of the present invention will now be described in greater detail, by way of example only and with reference to the following figures, in which.

DETAILED DESCRIPTION OF THE INVENTION

Figure 1:
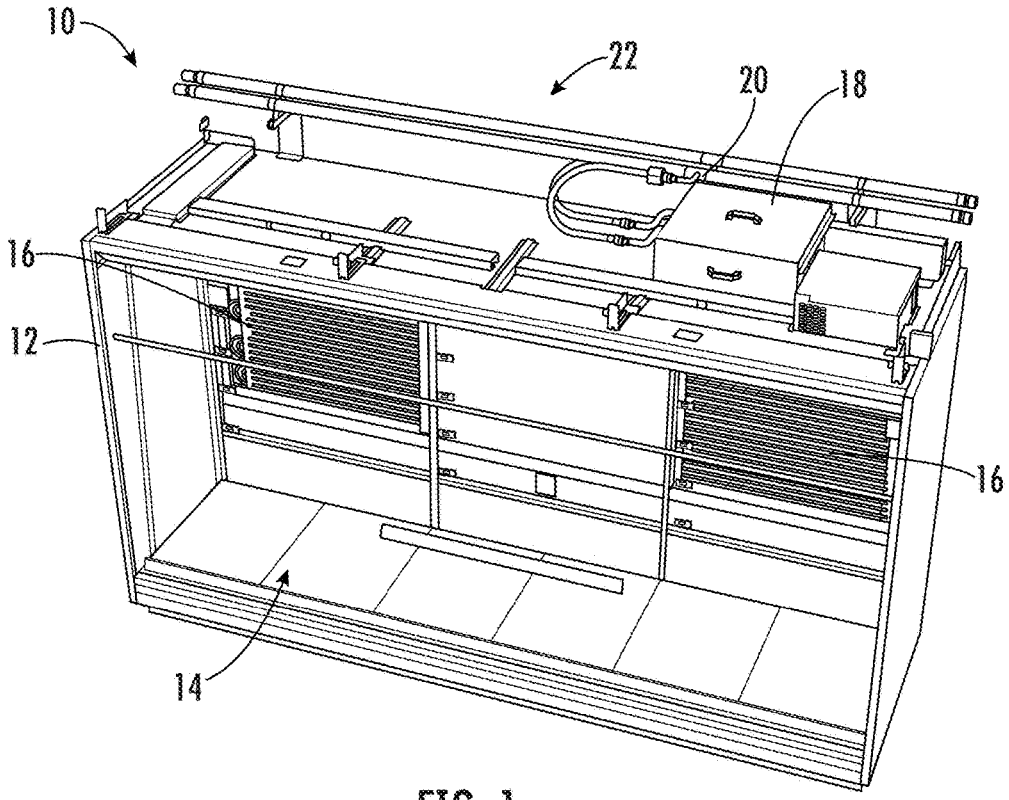
FIG. 1 shows a refrigerated display cabinet with refrigerant leak mitigation.

FIG. 1 shows an example of a refrigerated display cabinet 10 with refrigerant leak mitigation. The refrigerated display cabinet 10 includes a main body 12 which comprises a storage space 14 and heat absorption heat exchangers (evaporators) 16. The refrigerated display cabinet 10 also includes a container 18 located on top of the main body 12. The container 18 having a vent 20 and is configured to be air tight with the exception of the vent 20.

The evaporators 16 are configured to chill the storage space 14 such that products can be maintained at a desired cool temperature when stored within the refrigerated display cabinet 10. The evaporators 16 form part of a refrigeration loop which further comprises at least a compressor, a condenser and a throttling element which are connected to one another (not visible in FIG. 1).

In the example shown in FIG. 1 at least the condenser and compressor are housed within the container 18. In this example the condenser is a liquid cooled heat exchanger which receives cooling fluid from an external source via cooling supply pipes 22.

By housing components of the refrigerant loop within the container 18 if any of those components were to leak refrigerant the leaking refrigerant will build up within the container 18. As the refrigerant builds up within the container 18 the pressure within the container 18 increases relative to the atmosphere surrounding the refrigerated display cabinet 10. This increase in pressure subsequently causes the built up refrigerant to be ejected in a jet from the vent 20.

Figure 2:
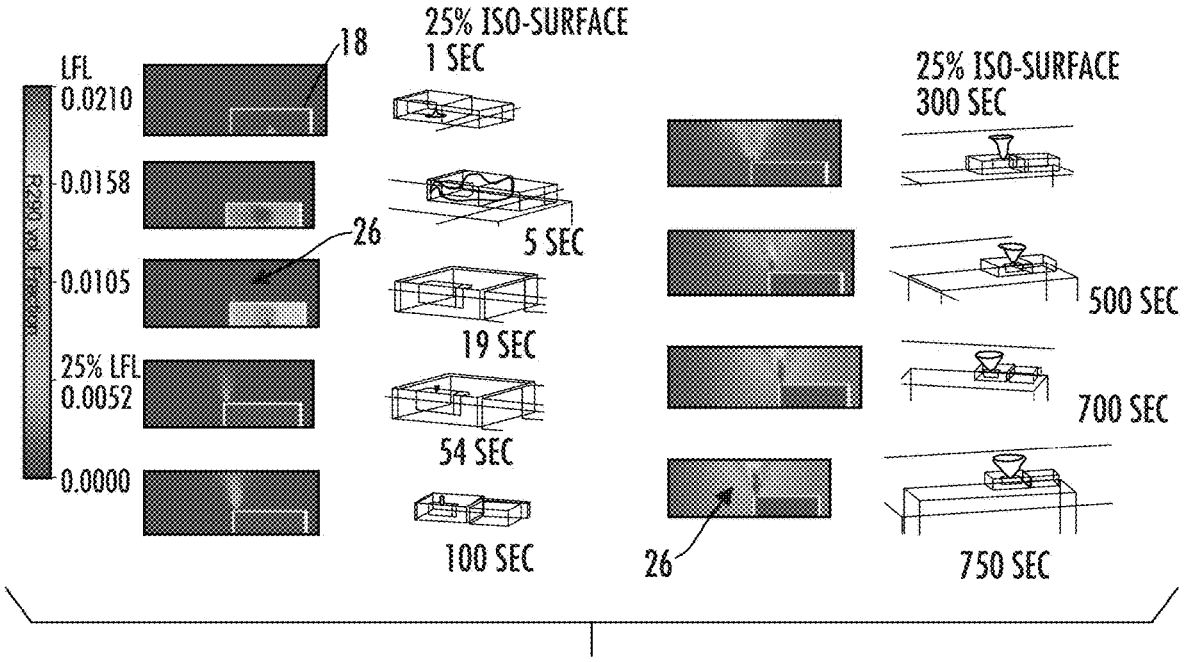
FIG. 2 shows the refrigerant leak mitigation of FIG. 1.

The ejection of leaked refrigerant from the container 18 via the vent 20 is shown in more detail in FIG. 2. FIG. 2 shows the evolution of a refrigerant leak from a component of the refrigerant loop housed within the container 18 against time to demonstrate the ejection of leaked refrigerant via the vent 20. It will be appreciated that the timing of the leak development and ejection from the container 18 will be dependent on the rate at which the refrigerant leaks from a component of the refrigerant loop.

In this example, at 19 seconds it can be seen that a jet 26 of refrigerant begins to form at the vent 20. From 19 seconds to 750 seconds it can be seen that the jet 26 becomes more defined. The jet 26 is caused by the increase in pressure within the container due to the leak relative to the atmosphere outside of the container in combination with the vent 20 having a cross sectional area that provides flow resistant at a predetermined pressure.

As refrigerant is heavier than air the jet 26 decelerates as it leaves the vent 20. That is, the jet 26 of refrigerant slows as it moves away from the vent 20. Due to gravity the refrigerant jet 26 will eventually change direction from being opposed to gravity to in the gravitational direction. This change in direction resembles a fountain and causes significant mixing of the refrigerant with the ambient air, which hence dilutes the refrigerant.

Advantageously, leaking refrigerant, which may be flammable or explosive, does not build up in the vicinity of the refrigerated display cabinet but instead is held with the container 18 before being diluted with the atmosphere surrounding the refrigerated display cabinet. That is, the present invention avoids leaked refrigerant building up to a dangerous concentration proximate to the leak source without any mitigation measures.

Figure 3:
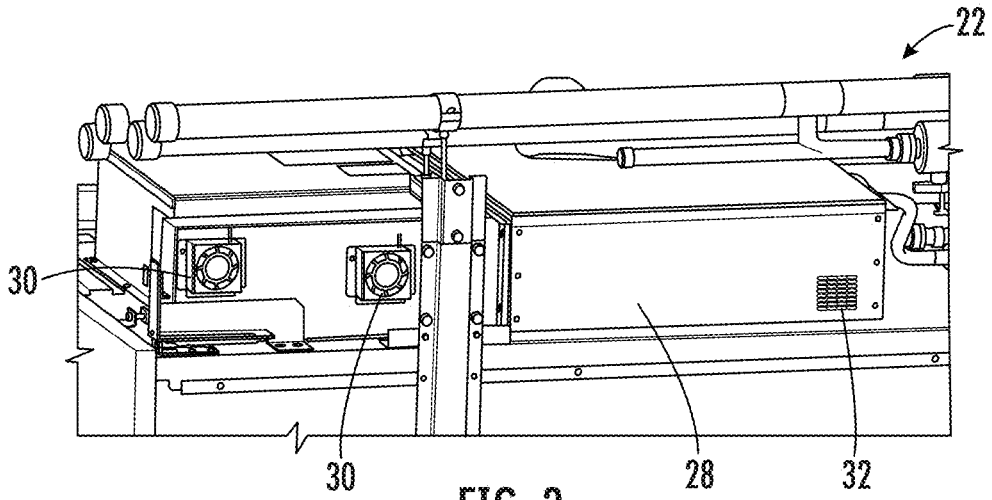
FIG. 3 shows a refrigerated display cabinet with refrigerant leak mitigation.

FIG. 3 shows another example of a refrigerated display cabinet 10 with refrigerant leak mitigation. In this example the container 28 comprises two venting fans 30 and two air inlets 32.

Venting fans 30 are configured to operate continuously to expel fluid from within the container 28. That is fluid is drawn in to the container via air inlets 32 and expelled from the container 28 via the venting fans 30.

Advantageously any leaking refrigerant is entrained within the fluid flow generated by the drawing in of fluid at the air inlets 32 and is expelled at the venting fans 30. This prevents leaking refrigerant from building up with the container 28. It also prevents leaking refrigerant from building up in the vicinity of the refrigerated cabinet 10 as it mixes and dilutes with surrounding air when blown from the container.

In having two venting fans 30 and two air inlets 32 redundancy is provided to ensure that even in the event of a venting fan 30 failing or an air inlet 32 being blocked that leak mitigation can be provided.

Figure 4:
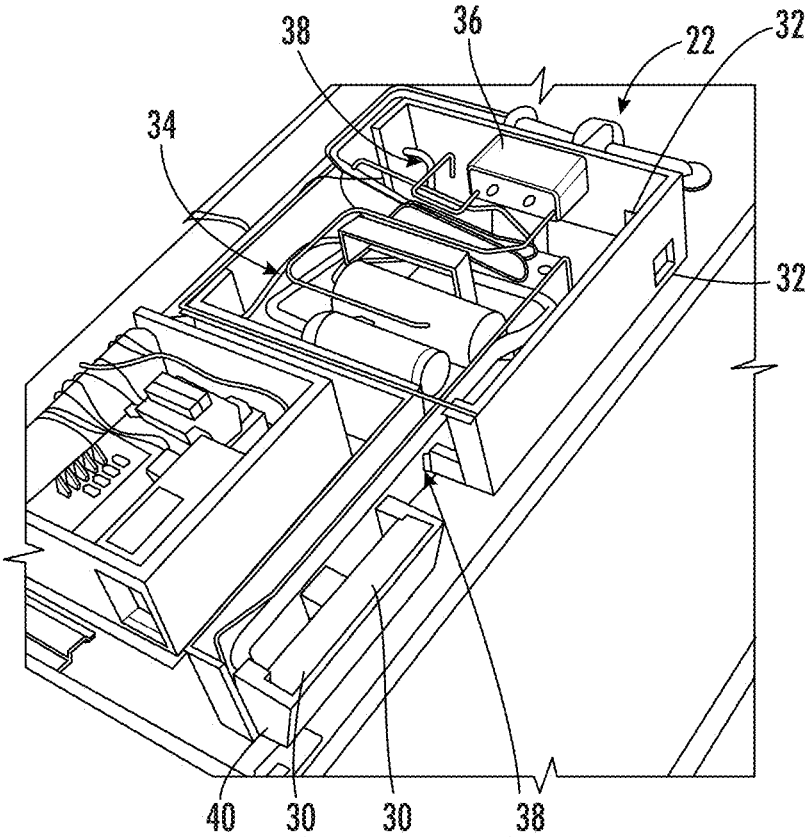
FIG. 4 shows the internal arrangement of refrigerant loop components within a container.

Venting fans 30 may be configured to expel fluid in a direction substantially horizontally as shown in FIG. 3 or may be configured to expel fluid in a vertical direction, for example and as shown in FIG. 4, via a flow director 40 placed proximate the venting fans 30 to direct the fluid flow in a desired direction.

Figure 5:
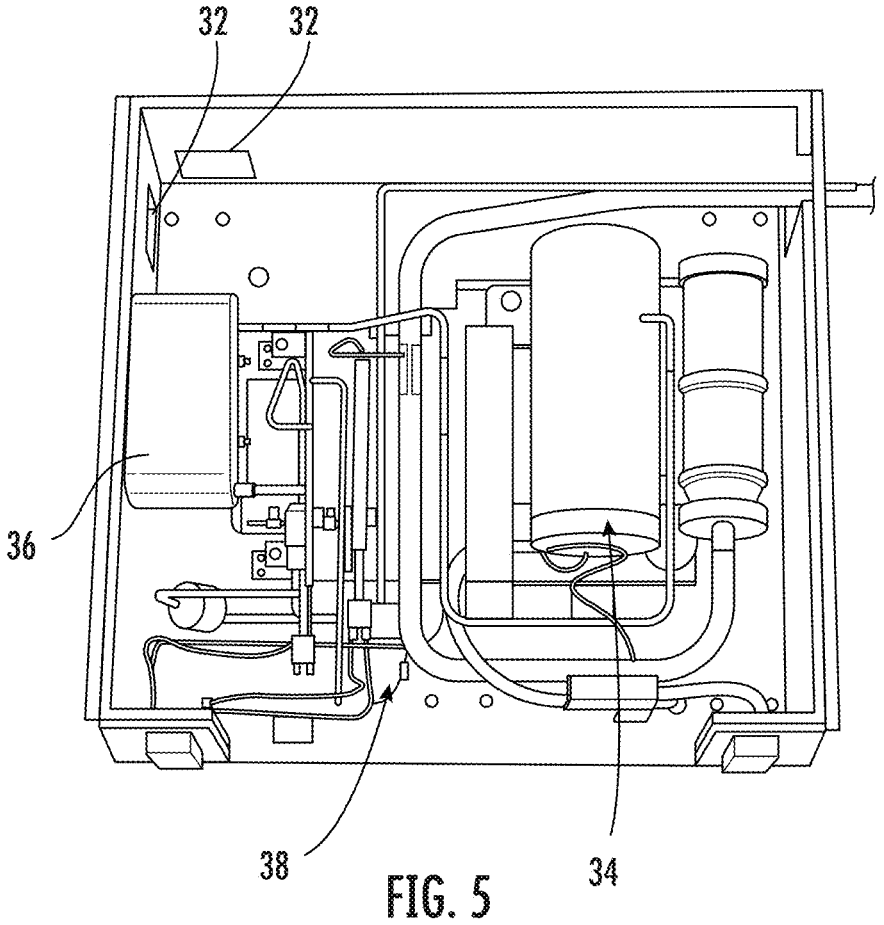
FIG. 5 shows another view of the internal arrangement of refrigerant loop components within a container.

FIGS. 4 and 5 show the internal arrangement of components within container 28 of the refrigerated display cabinet 10 shown in FIG. 3. The internal arrangement of components within the container shown in FIG. 1 are broadly the same. The container 28 contains compressor 34, condenser 36 and refrigerant supply pipes 38. In this example the condenser 36 is a liquid cooled condenser wherein cooling fluid is provided by cooling supply pipes 22.

Therefore a leak of refrigerant from any of the compressor 34, condenser 36 or refrigerant supply pipes 38 can be contained within the container 28 and ejected via venting fans 30. The leaked refrigerant diluting with the surrounding air when ejected.

In the examples shown the container 18, 28 has a somewhat flag shape, that is the container 18, 28 has a narrow rectangular shape extending into a larger more square portion. In the examples provided this shape is to ensure that the interface where the refrigerant supply pipes 38 enter the main body 12 are contained within the container 18, 28. It will be appreciated however that the container may be any other suitable shape dependent on the precise location that it is installed and the arrangement of refrigeration components within the container 18, 28.

What is claimed is:

1. A refrigerated display cabinet, comprising:

a refrigeration loop comprising a compressor, a condenser, a throttling element and an evaporator which are connected;

a main body comprising a storage space, wherein the evaporator is located within the main body and is for supplying cooling to the storage space; and a container located outside of the storage space and containing at least one of the compressor, condenser and throttling element, wherein the container comprises a vent configured to discharge any build-up of gases within the container outwardly in a high velocity stream and in a jetting fashion.

2. The refrigerated display cabinet according to claim 1, wherein the container is located above the main body.

3. The refrigerated display cabinet according to claim 1, wherein the container is located below the storage space.

4. The refrigerated display cabinet according to claim 1, wherein the condenser is a liquid cooled condenser.

5. The refrigerated display cabinet according to claim 1, wherein the vent is located on an inner wall of the container and is configured to enable fluid communication between the interior of the container and the interior of the storage space such that any build-up of gases within the container is discharged into the storage space.

6. The refrigerated display cabinet according to claim 1, wherein the vent is located on an outer wall of the container and is configured to discharge any build-up of gases from within the container in a direction outwards.

7. The refrigerated display cabinet of claim 6, wherein the container comprises a second vent, the second vent being located on an inner wall of the container and is configured to enable fluid communication between the container and the storage space such that higher pressure within the storage space causes an increase in the flow rate of any build-up of gases exiting the first vent from within the container.

8. The refrigerated display cabinet of claim 1, wherein the container is configured to be air tight with the exception of the vent(s).

9. The refrigerated display cabinet of claim 1, comprising:

a venting fan for discharging any build-up of gases within the container outwardly from the container.

10. The refrigerated display cabinet of claim 9, comprising:

a second venting fan for discharging any build-up of gases within the container outwardly from the container; and an air inlet.

11. The refrigerated display cabinet of claim 9, comprising:

a second venting fan located at an air inlet for drawing air into the container from outside.

12. A method of refrigerant leak mitigation for a refrigerated display cabinet, the method comprising:

capturing leaking refrigerant from refrigerant loop components of a refrigerated display cabinet within a container; and venting the build-up of refrigerant from the container outwardly in a high velocity stream and in a jetting fashion.

13. A method for manufacturing a refrigerated display cabinet with refrigerant leak mitigation, the method comprising:

providing a refrigerated display cabinet including:

a refrigeration loop comprising a compressor, a condenser, a throttling element and an evaporator which are connected;

a main body comprising a storage space, wherein the evaporator is located within the main body and is for supplying cooling to the storage space;

a container located outside of the storage space and containing at least one of the compressor, condenser and throttling element; and forming a vent in the container configured to discharge any build-up of gases within the container outwardly in a high velocity stream and in a jetting fashion.

14. The refrigerated display cabinet of claim 4, wherein the container is configured to be air tight with the exception of the vent(s).

15. A method according to claim 12, wherein the container is configured to be air tight with the exception of the vent(s).

16. A method according to claim 15, wherein the refrigeration loop components comprise a condenser, and the condenser is a liquid cooled condenser.

17. A method according to claim 13, wherein the container is configured to be air tight with the exception of the vent(s).

18. A method according to claim 17, wherein the condenser is a liquid cooled condenser.

* * * * *